US008080785B2

(12) United States Patent
Javahery et al.

(10) Patent No.: US 8,080,785 B2
(45) Date of Patent: Dec. 20, 2011

(54) HIGH PRESSURE COLLISION CELL FOR MASS SPECTROMETER

(75) Inventors: Gholamreza Javahery, Kettleby (CA); Lisa Cousins, Woodbridge (CA); Charles Jolliffe, Schomberg (CA)

(73) Assignee: Ionic Mass Spectrometry Group, Concord, ON (CA)

( * ) Notice: Subject to any disclaimer, the term of this patent is extended or adjusted under 35 U.S.C. 154(b) by 458 days.

(21) Appl. No.: 12/230,949

(22) Filed: Sep. 8, 2008

(65) Prior Publication Data

US 2009/0065692 A1 Mar. 12, 2009

Related U.S. Application Data

(60) Provisional application No. 60/935,997, filed on Sep. 10, 2007.

(51) Int. Cl.
*H01J 49/00* (2006.01)

(52) U.S. Cl. ..... 250/290; 250/281; 250/282; 250/287

(58) Field of Classification Search ..... 250/281, 250/282, 287, 288, 289
See application file for complete search history.

(56) References Cited

U.S. PATENT DOCUMENTS

| | | | | |
|---|---|---|---|---|
| 5,942,752 | A * | 8/1999 | Wang | 250/288 |
| 6,093,929 | A * | 7/2000 | Javahery et al. | 250/282 |
| 6,259,091 | B1 * | 7/2001 | Eiden et al. | 250/281 |
| 6,512,225 | B2 | 1/2003 | Vestal et al. | |
| 6,534,764 | B1 * | 3/2003 | Verentchikov et al. | 250/287 |
| 6,858,840 | B2 | 2/2005 | Berkout et al. | |
| 6,919,562 | B1 * | 7/2005 | Whitehouse et al. | 250/288 |
| 7,034,292 | B1 * | 4/2006 | Whitehouse et al. | 250/289 |
| 7,049,584 | B1 * | 5/2006 | Whitehouse et al. | 250/288 |
| 7,087,897 | B2 * | 8/2006 | Bateman et al. | 250/287 |
| 7,309,861 | B2 * | 12/2007 | Brown et al. | 250/290 |
| 2005/0242281 | A1 * | 11/2005 | Li | 250/292 |

* cited by examiner

*Primary Examiner* — Michael Maskell
(74) *Attorney, Agent, or Firm* — Lynn C. Schumacher; Hill & Schumacher

(57) ABSTRACT

A high pressure collision cell for use in a mass spectrometer. The high pressure collision cell has a cell length L selected to be in a range such that upon application of voltages to a pair of opposed elongate electrically conducting electrodes there is produced an electric field of sufficient strength across the collision cell length L in to aid in directing ions entering the collision cell to along a transverse flow axis. The pressure in the collision cell is maintained in a range from about 50 mTorr to 1000 mTorr and wherein the collision cell length L and the pressure are selected such that a target thickness, defined as a product of the collision cell length L and the pressure, is maintained in a range from about 0.2 to about 2 mm-Torr.

33 Claims, 9 Drawing Sheets

HIGH PRESSURE COLLISION CELL FOR MASS SPECTROMETER

CROSS REFERENCE TO RELATED U.S. APPLICATIONS

This patent application relates to, and claims the priority benefit from, U.S. Provisional Patent Application Ser. No. 60/935,997 filed on Sep. 10, 2007, in English, entitled HIGH PRESSURE COLLISION CELL, and which is incorporated herein by reference in its entirety.

FIELD OF THE INVENTION

The present invention relates to a high pressure collision cell for use in a mass spectrometer.

BACKGROUND OF THE INVENTION

Mass spectrometry (MS) is a well-known technique for obtaining a molecular weight and structural information on chemical compounds. According to mass spectrometry, molecules may be "weighed" by ionizing the molecules and measuring the response of their trajectories in a vacuum to electric and magnetic fields. Ions are "weighed" according to their mass-to-charge (m/z) values.

In tandem mass spectrometry, precursor ions are selected by the first mass filter. The selected ions are accelerated to a desired kinetic energy, typically by accelerating them across a potential difference into a gas-filled collision cell. Collisions in the presence of the collision gas induce fragmentation, also known as collision induced dissociation (CID). Fragment ions are then filtered by the second means of mass filtering. The product of the collision cell length and the pressure (length×pressure) is known as the target thickness. The incoming beam of precursor ions requires a certain target thickness in order to be fragmented and in order for the fragments to then be thermalized. The type of fragment ion produced, and the number of fragment ions produced, are in part determined by the collision energy, collision partner and pressure of the collision cell.

Generally, a collision cell includes multiple elongated ion guide rods, grouped in two poles, enclosed in a shell or housing. Two opposed electrically conducting electrodes, each forming an electrostatic lens at each end of the collision cell complete the enclosure. Most collision cells include parallel ion guide rods, often arranged in sets of two, three or four rod pairs. RF voltages of opposite phases are applied to opposing pairs of the rods to generate an electric field that contains the ions as they are transported from the entrance to the exit.

Conventionally, ions are accelerated across a potential drop of 20-50V or more, with the pressure maintained between 1 to 10 mTorr by introduction of collision gas ($N_2$, air or Ar). The length of the collision cell is typically not less than 15 cm since the ions must experience a minimum number of collisions at the limited pressure range of 1 to 10 mTorr. Higher pressures and shorter lengths are not possible with conventional cells due to restrictions in pumping technology.

Therefore, conventional pumping systems require that collision cells are long, increasing the size and therefore limiting ease of use and increasing the complexity of mass spectrometers.

As well, because conventional collision cells operate in a limited pressure regime, they produce a restricted set of fragmentation patterns that may not always be useful, particularly for large molecules, greatly limiting the information content of a measurement. This is particularly true for large molecular ions for which low pressure CID is not useful.

Further, due to the length of the collision cell, an additional axial field is often superimposed on the collision cell which is required to move ions along from the entrance to the exit. The need for the axial field is significant as ions tend to slow down almost to a halt without it. A suitably shaped axial field may, for example, be produced by manipulating the shape of the electric field produced by the parallel rods. The relative voltages on the neighboring rods determine the axial field. Unfortunately, ion guides that rely on the shape of the electric field between the rods to produce an axial field tend to distort the electric field asymmetrically, reducing mass range and sensitivity. Other known ion guides use auxiliary electrodes in conjunction with the guide rods to produce a suitably shaped axial electric field. A DC voltage is applied to the auxiliary electrodes that, in conjunction with the rod set, serve to produce an axial field. Unfortunately, the use of auxiliary electrodes tends to be complex and expensive. For example, for 2n guide rods in the ion guide, there will be 2n auxiliary rods, giving a total of 4n rods, increasing cost and complexity substantially.

Accordingly, there remains a need for a collision cell that is small in size, provides an axial field and as well provides for alternative fragmentation pathways not available in currently available collision cells, while optimizing the use of differential pumping technology.

Additionally it is desirable to provide an improved mass collision cell for mass spectrometers which is more compact and economical than presently available collision cells.

SUMMARY OF THE INVENTION

In the broadest aspect of the invention there is provided a high pressure collision cell.

An embodiment of the high pressure collision cell for use in a mass spectrometer, comprises:

a) a first housing enclosing a first chamber including first and second opposed elongate electrically conducting electrodes each having an aperture and spaced apart a length L thereby defining a collision cell length, each of said first and second opposed elongate electrically conducting electrodes forming an electrostatic lens, said first and second opposed elongate electrically conducting electrodes being positioned with respect to each other so that said apertures in each are generally aligned along a transverse flow axis through said first chamber between said first and second opposed elongate electrically conducting electrodes;

b) chamber walls between said first and second opposed elongate electrically conducting electrodes to enclose said first chamber, said chamber walls being electrically isolated from said first and second opposed elongate electrically conducting electrodes and being sealed to said first and second opposed elongate electrically conducting electrodes in such a way as to provide a pressure seal;

c) a gas injection port on said housing for injecting an inert gas into said first chamber, a pumping port on said first housing and a pump for pumping said inert gas out of said first chamber;

d) a power supply for applying a selected voltage to said first and second opposed elongate electrically conducting electrodes; and e) said collision cell length L selected to be in a range such that upon application of said selected voltage to said first and second opposed elongate electrically conducting electrodes there is produced an electric field of sufficient strength across said collision cell length L in said first chamber to aid in directing ions entering said collision cell through one of said apertures along said transverse flow axis; and f) pressure controller for maintaining a pressure in said collision cell in a range from about 50 mTorr to 1000 mTorr and wherein said collision cell length L and said pressure are selected such that a target thickness, defined as a product of the collision cell length and the pressure, is maintained in a range from about 0.2 to about 2 mm-Torr.

The present invention provides a method for producing collisions to dissociate molecules during mass spectrometry, comprising:

directing an ion beam containing molecules being analyzed into a collision cell having a collision cell length L, and having a pressure maintained in a range from about 50 mTorr to 1000 mTorr and wherein said collision cell length L and said pressure are selected such that a target thickness, defined as a product of the collision cell length and the pressure, is maintained in a range from about 0.2 to about 2 mm-Torr, and said collision cell length L being selected to be in a range such that upon application of voltages electrodes forming part of the collision cell, there is produced an electric field of sufficient strength across said collision cell length L to aid in directing ions entering said collision cell along a transverse flow axis through said collision cell.

If a goal is collision induced dissociation, an embodiment of the method may include not meeting the axial field requirement above, but operating with a conventional collision cell length as in conventional collision cells but higher pressure (about 50-1000 mTorr), therefore providing substantially larger target thickness, a range particularly useful for CID of large molecular ions such as proteins and other macromolecular ions.

Thus, in another aspect of the present invention, there is provided a high pressure collision cell for use in a mass spectrometer, comprising:

a) a first housing including first and second opposed elongate electrically conducting electrodes each having an aperture and spaced apart a length L thereby defining a collision cell length, each of said first and second opposed elongate electrically conducting electrodes forming an electrostatic lens, said first and second opposed elongate electrically conducting electrodes being positioned with respect to each other so that said apertures in each are aligned along a transverse flow axis through said first chamber between said first and second opposed elongate electrically conducting electrodes;

b) chamber walls enclosing a first chamber between said first and second opposed elongate electrically conducting electrodes, said chamber walls being electrically isolated from said first and second opposed elongate electrically conducting electrodes and being sealed to said first and second opposed elongate electrically conducting electrodes in such a way as to provide a pressure seal;

c) gas injection port for injecting an inert gas into said first chamber, and an external pumping volume for pumping said inert gas out of said first chamber;

d) a power supply for applying a selected voltage to said first and second opposed elongate electrically conducting electrodes; and e) a second housing enclosing a second chamber, said first housing being located inside said second housing, said second housing having first and second opposed side walls each forming an electrostatic lens, each of said first and second opposed sidewalls having an associated aperture, said wherein said pumping port is connected to said second housing in flow communication with a pump for pumping said first and second chambers for differentially pumping said first and second collision cell housings compared to an interior of a spectrometer housing in which said collision cell is retrofitted, and wherein said pressure controller is configured to maintain a pre-selected pressure in said first and second chambers.

This high pressure collision cell may include a pressure controller for maintaining a pressure in said collision cell in a range from about 50 mTorr to about 1000 mTorr.

In this aspect of the invention there is provided a method for producing high energy collisions to dissociate molecules during mass spectrometry, comprising directing an ion beam containing molecules being analyzed into a collision cell and having a pressure maintained in a range from about 50 mTorr to about 1000 mTorr applying voltages to electrodes located in said collision cell suitable to provide lab frame collision energies in a range of from about 10 to about 500V for collision-induced dissociation (CID) of large molecules.

A further understanding of the functional and advantageous aspects of the invention can be realized by reference to the following detailed description and drawings.

BRIEF DESCRIPTION OF THE DRAWINGS

The method and apparatus for reducing collision cell size, reducing axial field complexity, and improving selectivity in mass spectrometry, in accordance with the present invention will now be described, by way of example only, reference being made to the accompanying drawings, in which.

DETAILED DESCRIPTION OF THE INVENTION

The systems described herein are directed, in general, to embodiments of collision cells for mass spectrometers and particularly high pressure collision cells. Although embodiments of the present invention are disclosed herein, the disclosed embodiments are merely exemplary and it should be understood that the invention relates to many alternative forms, including different shapes and sizes. Furthermore, the Figures are not drawn to scale and some features may be exaggerated or minimized to show details of particular features while related elements may have been eliminated to prevent obscuring novel aspects.

Therefore, specific structural and functional details disclosed herein are not to be interpreted as limiting but merely as a basis for the claims and as a representative basis for enabling someone skilled in the art to employ the present invention in a variety of manner. For purposes of instruction and not limitation, the illustrated embodiments are all directed to embodiments of high pressure collision cells for mass spectrometers.

As used herein, the term "about", when used in conjunction with ranges of dimensions or pressures or other physical properties or characteristics, is meant to cover slight variations that may exist in the upper and lower limits of the ranges of dimensions or pressures so as to not exclude embodiments where on average most of the dimensions are satisfied but where statistically dimensions may exist outside this region. It is not the intention to exclude embodiments such as these from the present invention.

As used herein, the phrase "target thickness" means the product of the collision cell length and the pressure (length× pressure).

As used herein, the term "aligned" means generally lined up or within line of sight and is not intended to exactly restrict an orientation or relationship between objects.

The invention herein discloses a collision cell that provides a low complexity axial field to accelerate ions along the axis of the collision cell, additional fragmentation patterns, and pumping technology that provides for very high signal-to-noise.

Figure 1A:
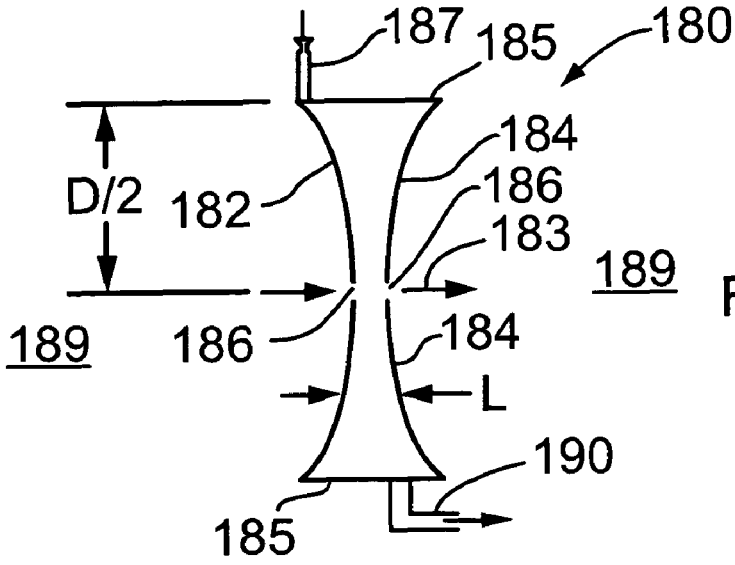
FIG. 1*a* shows an embodiment of a high pressure collision cell constructed in accordance with the present invention.

Referring to FIG. 1*a*, a high pressure collision cell constructed in accordance with the present invention for use in a mass spectrometer is shown generally at 180. High pressure collision cell 180 includes a chamber formed by two opposed electrically conducting electrodes 182 and 184 each having an aperture 186 (one being an entrance and the other an exit from the cell 180) and spaced apart a length L thereby defining a collision cell length, preferably in a range of 2-50 mm, and walls 185 that enclose the volume between the electrodes 182 and 184. In combination, the electrodes 182, 184 and walls 185 define the pressurized volume of the collision cell 180 that contains collision gas.

Each of the opposed electrically conducting electrodes 182 and 184 form an electrostatic lens with the electrodes being positioned with respect to each other so that the apertures 186 in each of the electrodes 182 and 184 are aligned along a transverse flow axis 183 through the volume between conducting electrodes 182 and 184. Electrodes 182 and 184 may be geometrically shaped such as shown in FIG. 1*a* to aid in focusing, or may be planar and elongate. Walls 185 of the cell are located a distance D/2 from flow axis 183. Walls 185 may be electrically conductive, electrically insulating or semiconducting as will be discussed in more detail below.

Walls 185 may be electrically isolated from electrodes 182 and 184 via electrically isolating spacers such as Lexan™, Teflon™, and the like, permitting separate voltages to be applied to each of electrodes 182, 184 and walls 185. Vacuum seals such as Teflon™ or O-rings™ may be further used to seal the housing from leaks.

In a practical implementation walls 185 may be made of a single continuous cylinder of radius D/2 forming a chamber wall or it may be made of a cone, a shaped cylinder, a rectangle, and the like. Walls 185 may be at least partially conductive. Furthermore walls 185 may further be split into two, three, four or more electrically isolated and vacuum sealed sections to which separate voltages may be applied.

Collision cell length L is selected such that an electric field E of sufficient strength is maintained across the collision cell length L to provide confinement of ions entering the collision cell through one of apertures 186 along the transverse flow axis 183 and out of the other aperture 186, and wherein the collision cell length and the pressure are selected such that a target thickness, defined as a product of the collision cell length and the pressure, is maintained on the order of about 0.2 to about 2 mm-Torr. The value will vary over a large range, about 10-fold, due to requirements specific to a molecular ion, such as collision cross section, energy pathways, etc.

For example high pressure collision cell 180 with L=2, 10 and 50 mm may operate at a pressure of approximately 500 mTorr, 100 mTorr and 20 mTorr respectively.

The ratio of E/P, where E is an electric field strength across said length L, and P is the pressure, proportional to number density of inert gas atoms/molecules in the volume, is maintained to provide a minimum axial field on the order of 1 to 5 V per mm per Torr to aid in directing ions out of high pressure collision cell 180. The actual value may vary about 5 to 10-fold according to molecule and background gas, due to variations in the nature of the chemical and physical interactions. An axial field is particularly useful for quantitative analysis of molecular ions, to minimize an effect known as "crosstalk" in mass spectrometry.

A gas injection port 187 may be generally positioned along one of the walls 185 for injecting an inert gas into the volume or chamber between the electrodes 182 and 184.

Cell 180 may further include additional pumping port 190 to further control the gas flow and aid in guiding ions out of exit of aperture 186. Port 190 may be positioned at one or various positions on wall 185, or electrode 184, such that the gas flow has a directionality toward exit aperture 186.

To aid in further driving ions toward exit aperture 186 a gas injection nozzle or aperture may be positioned parallel to flow axis 183. For example gas may be injected through an annular ring shaped aperture 301 positioned axially symmetric to apertures 186 generally lined up, or aligned, on flow axis 183 of electrode 182 as shown in FIG. 1*i*. It will be appreciated that there is a range of orientations that can constitute being aligned, for example the apertures need not be exactly aligned with their apertures on the same axis, but in general there is a line of sight between them. Thus aligned means generally lined up or within line of sight. Referring to the side view of FIG. 1*j*, gas 303 is injected through annular ring injection port 305. The diameter of the annular injection port 305 is adjusted such that the gas flow produces streamlines 307 that capture the ions in a flow and further provides a venturi pumping effect across entrance aperture 186, minimizing diffusion losses and enhancing sensitivity.

The external pumping volume shown generally at 189 in FIG. 1*a* is located at either end on the exterior of cell 180

(when in a spectrometer) for pumping the inert gas along a longitudinal direction between the electrodes 182 and 184 out of the collision cell in a direction which is substantially perpendicular to the transverse flow axis 183. Typical injection gases may include, but are not restricted to Ar, Xe, $N_2$, or an air mixture.

Figure 1B:
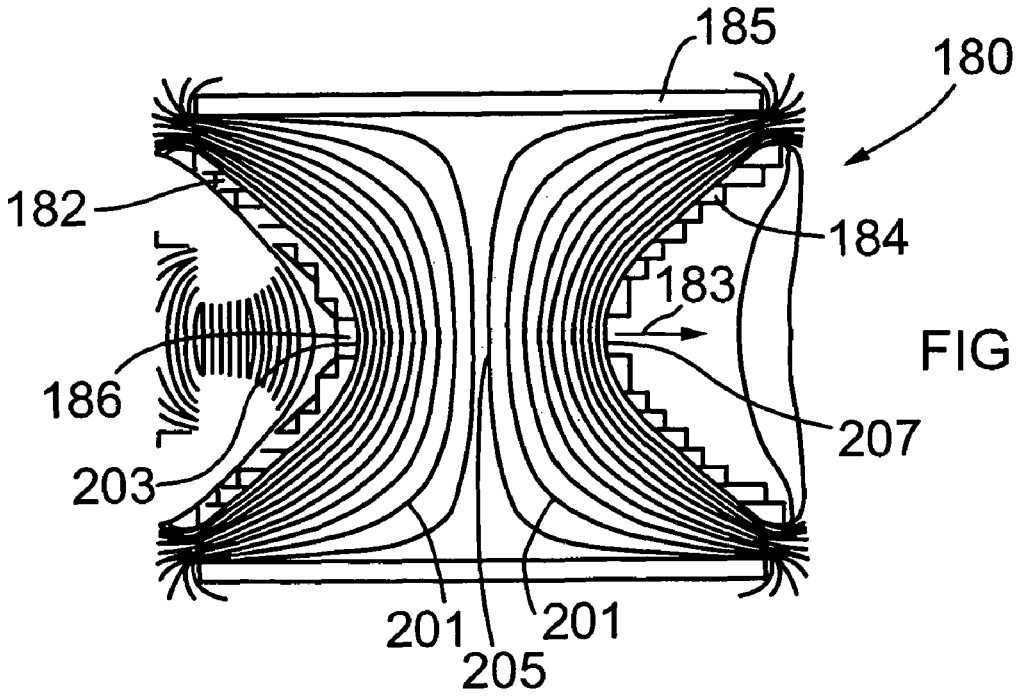
FIG. 1*b* shows potential contours of the high pressure collision cell of FIG. 1*a* for selected parameters such as electrode size, applied voltage etc. as specified and discussed hereinafter.

As an example, the embodiment of the collision cell 180 shown in FIG. 1*a* and FIG. 1*b* having shaped electrodes 182 and 184 may be configured to have a cell length L=12 mm as measured from entrance to exit apertures 186 along flow axis 183. In this embodiment walls 185 are conductive and are spaced a distance OF D/2=12 mm from axis 183. Walls 185 may be semi-conductive in addition to being conductive or insulating.

Figure 1C:
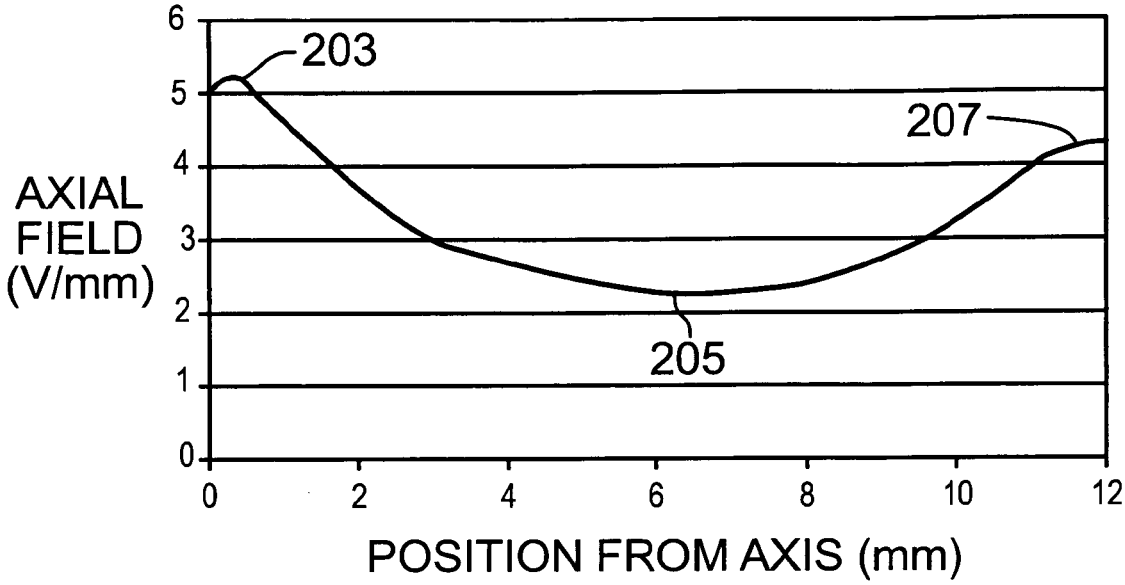
FIG. 1*c* shows a plot of axial field strength at various points along the axis of the collision cell for the parameters of FIG. 1*b;*

Equipotential surfaces shown generally at 201 are generated when, for example, electrode 182 is held at −35V, walls 185 at −60V and electrode 184 at −80V. An axial electric field is readily produced along axis 183 by combination of the electric field induced by voltage applied to electrodes 182, 184 and walls 185 as demonstrated in FIG. 1*c* where an axial field of 5 V/mm is generated at the entrance position 203, about 2.3V/mm at 205, and about 4V/mm at the exit at position 207 of FIG. 1*b*. Ions of positive polarity will drift from entrance position 203 to exit at position 207. The drift direction is opposite for ions of negative polarity. The strength of the axial field may be adjusted by adjusting L and D/2 of cell 180 and the voltages applied to walls 185, electrodes 182 and 184. For example, increasing D/2 will decrease the axial field strength. Further many combinations of voltages may be applied to the electrodes to generate an axial field. For example, an axial field of equal strength but opposite polarity may be generated by applying −80V voltage to electrode 182, −60V to walls 185 and −35V to electrode 184.

In operation the cell pressure may be maintained near 100 mTorr. Apertures 186 may be in the range of 0.2-2 mm. Voltages are applied to electrodes 182, 184 and the electrically conductive portion of walls 185 such that precursor ions are sufficiently accelerated through the entrance aperture 186 to a fragmentation threshold energy, and collisions with the gas cause some of the ions to dissociate, otherwise called collision-induced dissection (CID). The fragments (along with un-fragmented prescursor ions) are transmitted through exit aperture 186 by a combination of the shape of the electric field and the gas flow. Subsequent collisions of the fragments within the gas flow aid in thermalization of the ion kinetic energy.

Figure 1D:
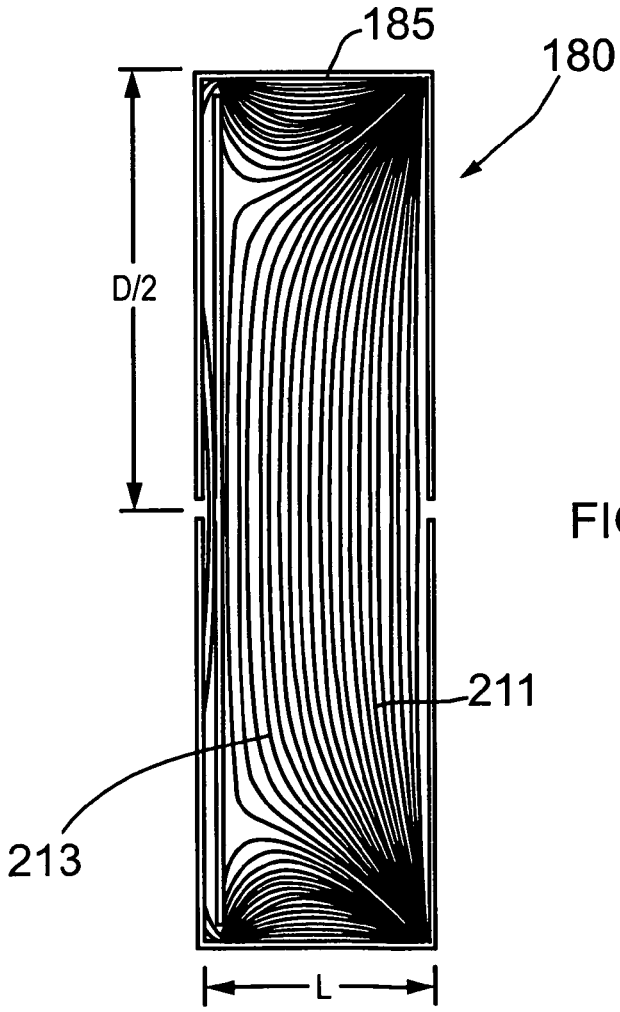
FIG. 1*d* shows potential contours of another embodiment of high pressure collision cell.
Figure 1E:
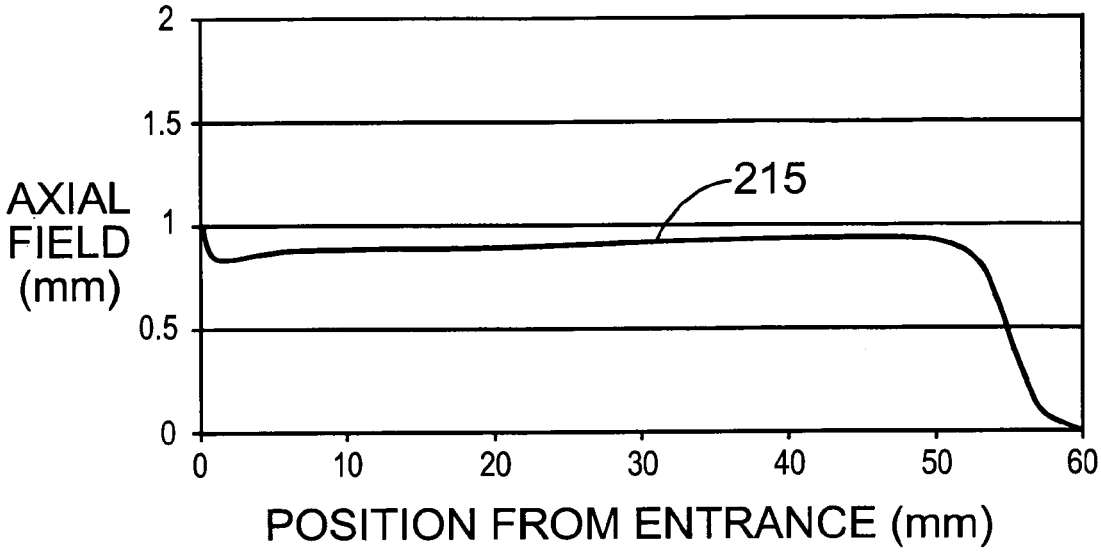
FIG. 1*e* shows a plot of axial field strength at various points along the axis of the collision cell for the parameters of FIG. 1*d;*

Alternatively the distance D/2 of walls 185 may be large with respect to the length of the cell L. In this way D/2 and L may be selected to yield a nearly constant axial field from entrance to exit. For example in collision cell 180 with L=50 mm and D/2=125 mm, as shown in FIG. 1*d*, enclosure distance D/2 is 2.5 times greater than cell length L. Here the voltage on walls 185 has a lesser effect over a range of typical range of voltages (for −100 to +100V, for example the penetration of the voltage from walls 185 is minimal). Setting the voltage on electrode 182 to −50V, electrode 184 to −100V, and walls 185 to ground, the resulting equipotentials shown generally at 211 and 213 in FIG. 1*d* are nearly parallel. The axial field produced is approximately 1V/mm across the length, shown at 215 in FIG. 1*e*. Thus the positional dependence of the axial field may be selected by selecting appropriate L and D/2, depending on the applied voltage and the relative differences on the electrodes. In the case of sufficiently large D/2, walls 185 may play little role in providing an axial field.

Figure 1F:
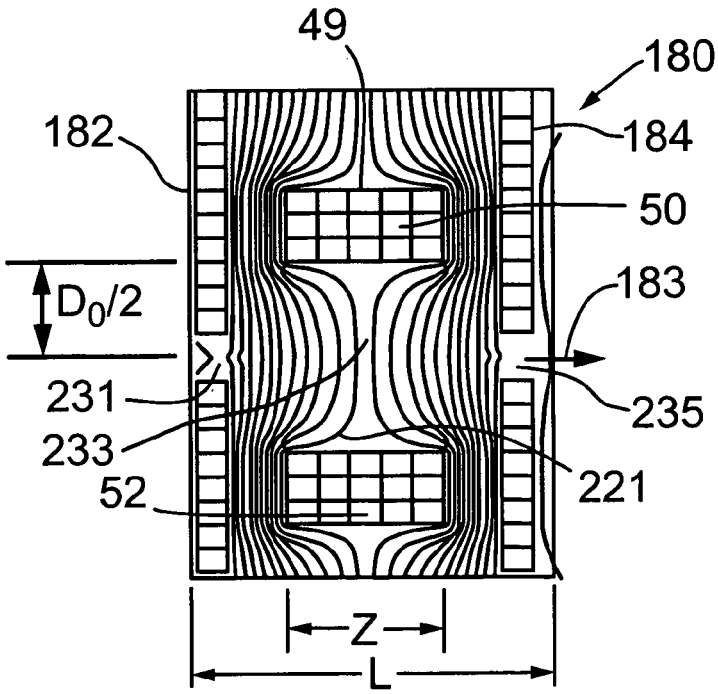
FIG. 1*f* shows potential contours of another embodiment of high pressure collision cell.

High pressure collision cell 180 may further include ion guide 49 comprising conducting electrodes 50 and 52 positioned axially symmetric as illustrated in FIG. 1*f*. Here the collision cell 180 length L is 12 mm. Inner conducting electrode 50 has length Z of 10 mm with an inner distance $D_0/2$ of 4 mm from transverse flow axis 183. Electrode 50 provides a substantial electric field contribution to the voltage along transverse flow axis 183 and shields the electric field of the conducting portion of wall 185 from transverse axis 183. Contours of equipotential 221 shown in FIG. 1*f* are produced by the applied voltages on electrode 182 of −35V, electrode 50 of −60V and electrode 184 of −80V. Electrodes 50 and 52 tend to shield the electric field of walls 150 from axis 183 thereby decreasing the extent to which walls 150 play a role in axial field, although not removing its effect entirely.

Thus it will be appreciated that in cases where the walls 185 are not used to provide an axial field effect, similar to FIGS. 1*e* and 1*f*, walls 185 may be constructed of non-insulating material, such as a ceramic.

As shown ion guide 49 is a multipole ion guide but may also be a conductive tube, an ion funnel, an ion trap, a series of stacked rings, and the like, to which DC and RF voltages may be applied, or some other generally axially symmetric conducting electrode to aid in transporting ions. Multipole ion guide may consist of rods, shims, cylindrical segments, rectangular segments, and the like.

Figure 1G:
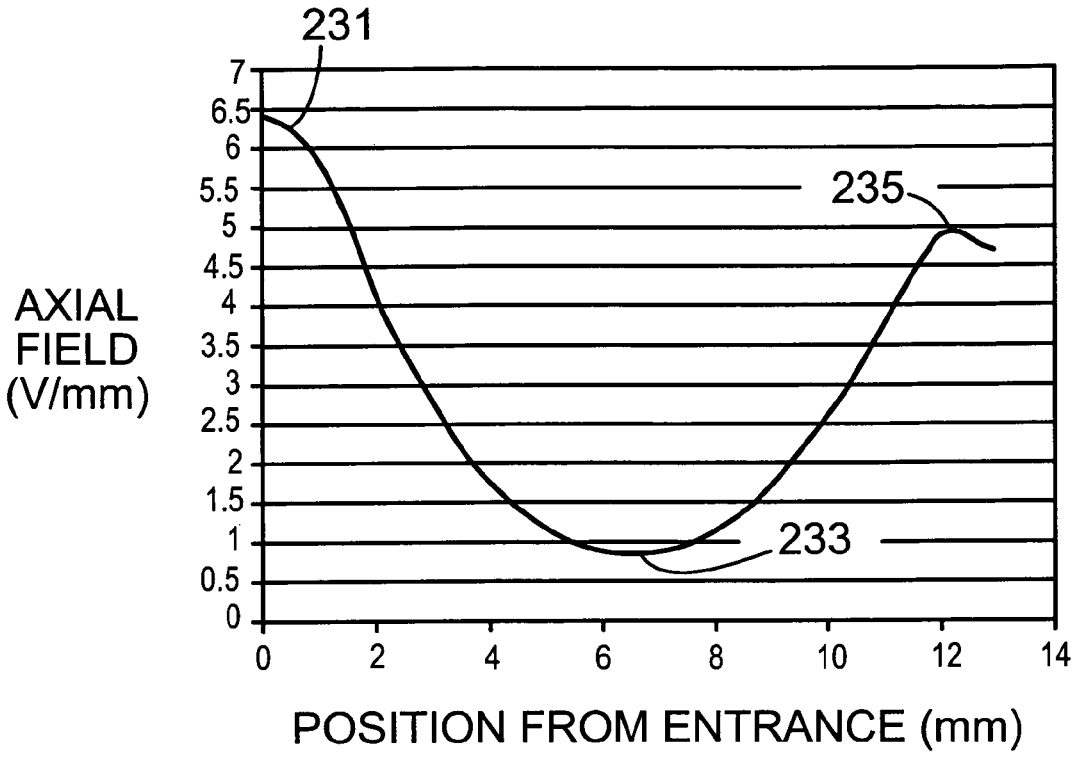
FIG. 1*g* shows a plot of axial field strength at various points along the axis of the collision cell for the parameters of FIG. 1*f;*

In FIG. 1*g*, the axial electric field is plotted as a function of axial position of a 12 mm cell 180 with elongate electrodes 182 and 184 and electrode 50. The axial field is about 7V/mm at the entrance 231 and drops to roughly 0.8V/mm near the center 233 before increasing to about 5V/mm at the exit 235, thus providing the axial field requirement for the 12 mm cell.

Figure 1H:
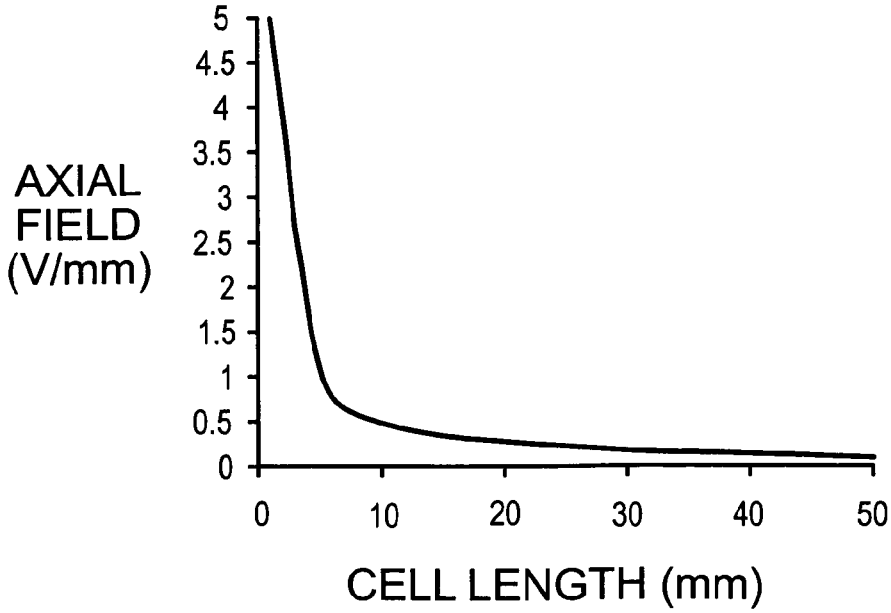
FIG. 1*h* shows a plot of approximate required axial field for various cell lengths.
Figure 1I:
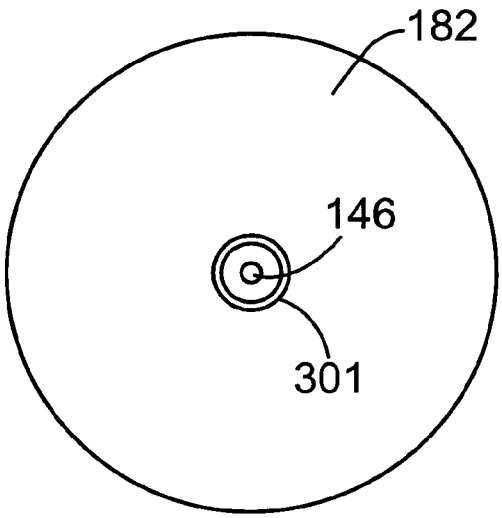
FIG. 1*i* shows an embodiment of a high pressure collision cell inlet for inletting gas to the high pressure collision cell.
Figure 1J:
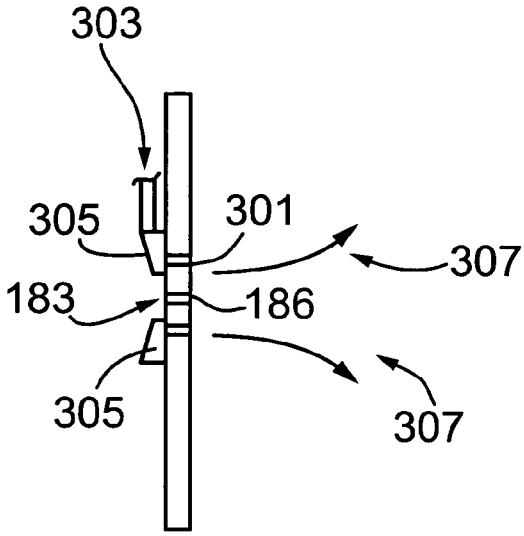
FIG. 1*j* shows a side view of FIG. 1*i;*

In general the required axial field is simply inversely proportional to the cell length since cell length is inversely proportional to pressure for a given target thickness. FIG. 1*h* plots axial field as a function of cell 180 length using an axial field requirement of 5V/mm-Torr and a target thickness requirement of 1 mm-Torr.

Figure 2A:
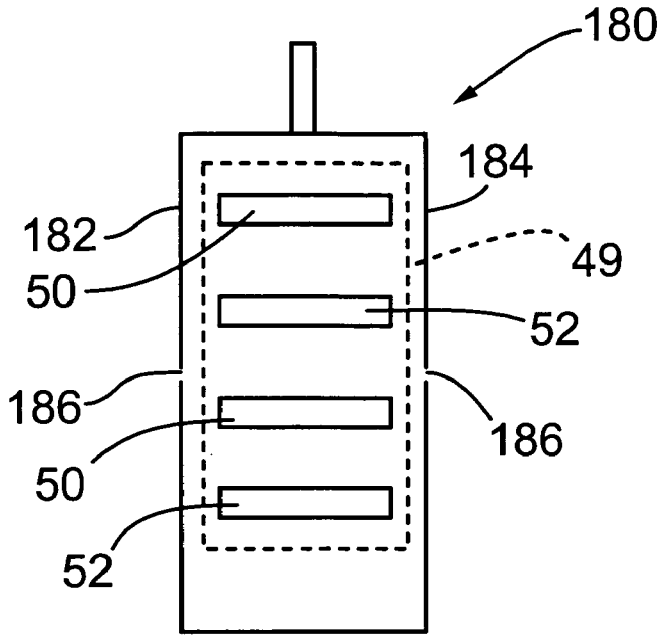
FIG. 2*a* shows an embodiment of another high pressure collision cell with ion guide.
Figure 2B:
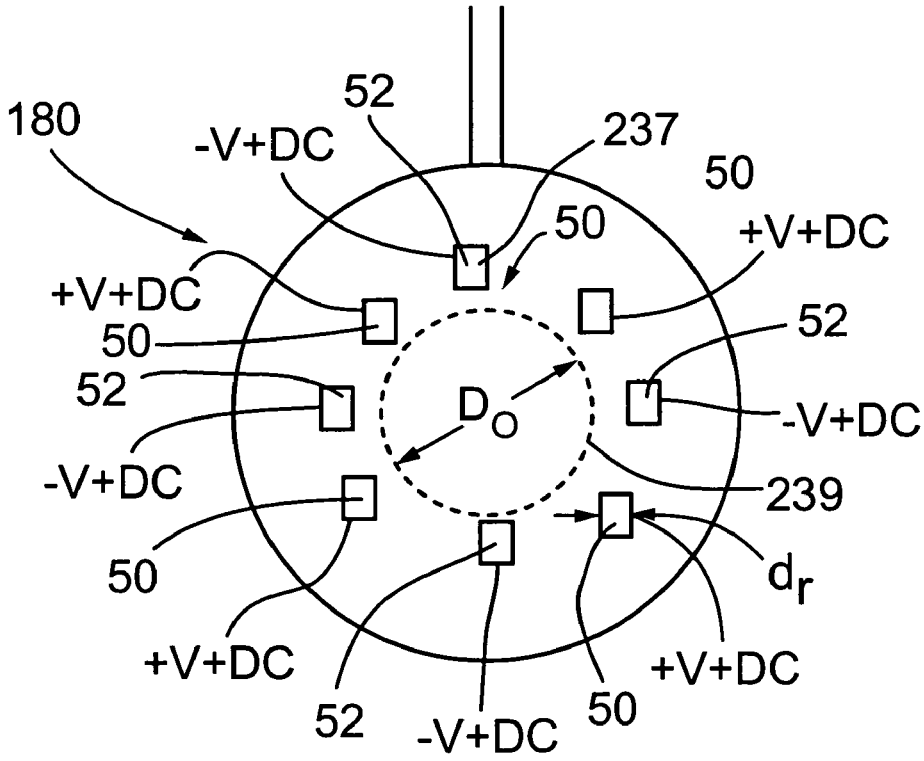
FIG. 2*b* shows a head-on view of the ion guide of FIG. 2*a;*

More specifically, ion guide 49 may be octopole, comprising four (4) electrodes 50 and four (4) electrodes 52 to aid in guiding ions from electrode 182 to 184 as illustrated in FIG. 2*a*. A head-on view is shown in FIG. 2*b*. Radiofrequency (RF) voltages are connected in a conventional fashion, such that a first electrode 50 has a +RF voltage applied thereto and a neighboring electrode 52 has −RF applied thereto, and all electrodes typically have the same DC voltage, commonly referred to as the DC offset voltage.

The voltage on electrodes 182 and 184, in combination with the DC offset voltage on ion guide 49, create an axial field along the flow axis 183. Preferably the diameter of ion guide 49 is sufficiently large to permit substantial field penetration of electrode 182 and 184. For example, for n rod pairs of multipole ion guides with diameter at 237 of dr, the circumscribed radius 239, given by Do/2 is approximately (n−1) $d_r/2$ so that for n=2, $D_o \sim d_r$; n=3, $D_o=2\ d_r$; and n=4 Do=3 $d_r$, etc.

For example, ion guide 49 as an octopole ion guide with four (4) sets of electrodes is shown, with each rod diameter of about 2 mm and the total circumscribed diameter 8 mm. With L=12 mm, this gives roughly the same axial field as in FIG. 1*f*.

Figure 3:
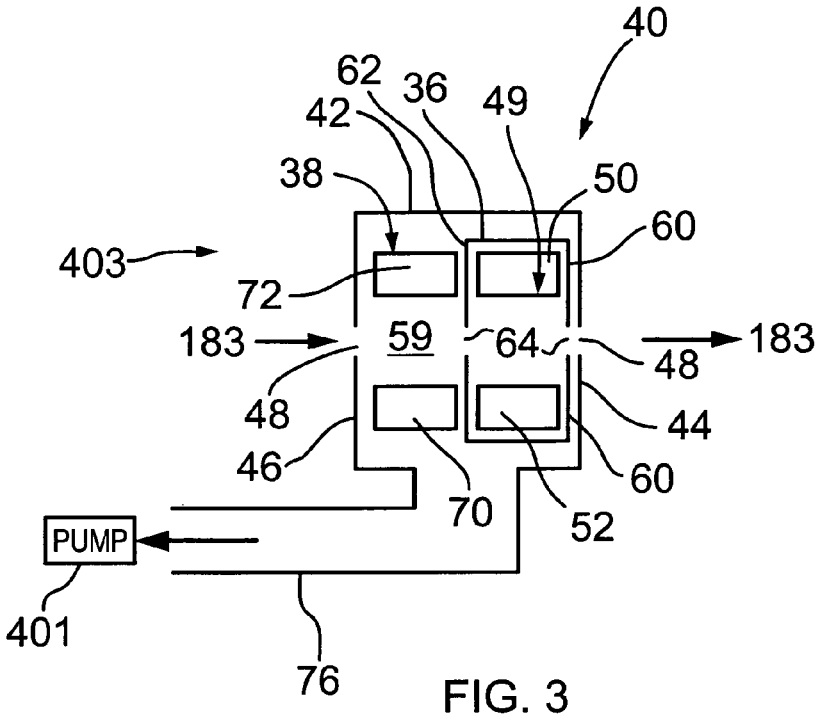
FIG. 3 shows another embodiment of a high pressure collision cell constructed in accordance with the present invention in which the cell is differentially pumped.
Figure 4:
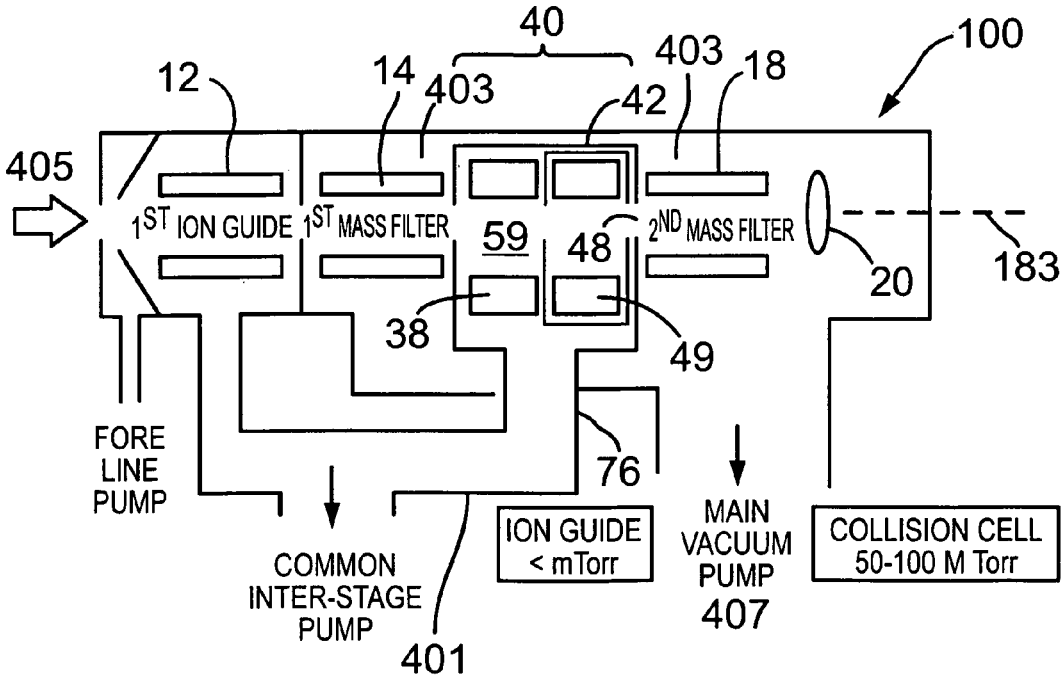
FIG. 4 shows a mass spectrometer containing the high pressure collision cell of FIG. 3.

In order to reduce the gas load on the mass spectrometer, a high pressure collision cell 40 may be constructed in accordance with the present invention, combining ion guide optics 38 in a lower pressure region 59 contained in an outer housing 42 with an inner housing 36 located within outer housing 42 containing the high pressure region as shown in FIG. 3 and FIG. 4. A pumping configuration is provided by conduit 76 and pump 401 (and may further comprise a port 190 of FIG. 1*a*) to pump the excess collision gas, reducing gas flow into the high vacuum part of the mass spectrometer thereby increasing efficiency of the mass filtering operation. Inner housing 36 is located along with focusing optics or ion guide 38, which includes electrodes 70 and 72, in outer housing 42 which has outer electrostatic lens electrodes 44 and 46 each at one of the ends of outer housing 42, forming side walls, with each electrode 44 and 46 having an aperture 48 along the transverse flow axis 183 of the cell 40.

Inner housing 36 of high pressure collision cell 40 may include an additional ion directing means such as ion guide 49 including electrodes 50 and 52 to which RF potentials of opposite phase are applied to neighboring electrodes. Inner housing 36 may also include inner electrostatic lens electrodes 60 and 62 each at one of the end of inner housing 36 with each electrode 60 and 62 having an aperture 64 aligned with apertures 48 in outer housing 42. RF potentials of opposite phase are further applied to neighboring electrodes of ion guide 38 of outer housing 42, located adjacent to inner housing 36. The interior of outer housing 42 is pumped through a conduit 76 by means of vacuum pump 401 to achieve lower pressure in low pressure region 59 thereby reducing the gas flow through apertures 48 Additional means of pumping using port 190 in cell 180 may also be provided as in FIG. 1*a* to further induce a flow and contain ions along transverse flow axis 183. Any suitable means of pumping may be used, depending on the desired throughput and the pressure, including a roughing pump; a drag stage of a turbomolecular pump; or a high vacuum stage of a turbomolecular pump.

As an example, apertures 48 and 64 in their respective electrostatic lense electrodes may have a 2.0 mm diameter opening. A pressure may be sustained at about 50 to about 100 mTorr within inner housing 36 of high pressure collision cell 40 by adjustment of inlet gas flow rate and outlet flow rate. Outlet flow rate may be adjusted by adjusting the size of apertures 64, the pumping speed combination of vacuum pump 401 and conduit 76, and pumping speed of any additional pumping on any additional port (not shown).

FIG. 4 shows a mass spectrometer 100 containing the high pressure cell 40. In operation, incoming ion beam 405 is transferred generally from a first stage ion guide 12 to a main vacuum chamber 403 pumped by separate pump 407 and is maintained at pressures typically near or less than $5\times10-5$ Torr. Main vacuum chamber 403 contains a first mass filter 14. Ions of a selected mass-to-charge are then transferred through entrance aperture 48 by means of voltage applied to electrostatic lens electrode 46 along axis 183 into ion guide 38 located in low pressure region 59 of housing 42. Voltages are applied on electrostatic lense electrodes 46 and 44 to optimize ion transfer.

For example, outer housing 42 of high pressure cell 40 may be maintained at a pressure of typically about 0.5 to about several mTorr when evacuated by an inter-stage pump 401 of 300 L/s while inner housing 36 may be maintained to about 100 mTorr. Importantly, because interstage pump 401 is already required to operate the mass spectrometer system, there is no substantial additional cost in this configuration. Ions are transmitted efficiently from outer housing 42 to inner housing 36 since within 2.0 mm path of acceleration ions normally experience <0.2 collisions which would have a minimal effect on scattering or preventing ions to reach its threshold fragmentation energy. Furthermore the leakage through the outer electrostatic lens electrodes 44 and 46 contributes less than typically 0.5 μTorr of pressure to the main vacuum chamber 403, reducing scattering losses and increasing sensitivity. Main vacuum chamber 403 is pumped by a separate vacuum pump 407. During transit through ion guide 38 ions may undergo several collisions at low energy which causes them to lose some of their radial and axial kinetic energies.

The voltage difference between the DC offset of ion guide 38 and ion guide 49 of high pressure collision cell 40 is selected to produce a lab frame collision energy that allows the precursor ion beam to gain the necessary energy to undergo fragmentation (CID) when in contact with collision gas.

Fragments and remaining precursor ions are guided out of inner housing 36 by means of an axial field formed by a combination of voltages on electrostatic lenses 60 and 62 and DC offset of ion guide 49. Collisions with background gas thermalize the ion energies.

As a particular example, ions with the ratio of m/z=1000 may require a target thickness of 2 mm-Torr. Using a collision cell of 20 mm length yields a required pressure of 100 mTorr of nitrogen. Ions may be accelerated to a selected lab frame collision energy by appropriate selection of voltages. For example, a lab frame collision energy on the order of 20 to 200V for a singly charged ion, with charge z=1 may be selected in order to induce fragmentation (i.e. CID). Even higher collision energies, for example up to 1000V, may be possible than conventional collision cells due to the increased pressure. Further, multiply charged ions with z>1, such as is commonly observed for peptides and proteins may be even further accelerated by the product of acceleration voltage and charge, Such large collision energies may be particularly useful for achieving CID on large ions and macromolecules, such as for example, but not limited to, proteins.

Collisions with the background gas subsequently thermalize the fragment ions. A 0.2V/mm axial field strength may be required to sweep ions from entrance to exit of aperture 64. The cell is maintained sufficiently short so that the field formed between the voltages placed on electrostatics lens electrodes 62, 60 and ion guide 49 produce the 0.2V/mm axial field strength, removing any need for additional axial field components.

Finally, a suitable voltage is applied to electrostatic lens electrodes 60 and 44 to ensure efficient transfer to the second mass filter 18, also contained in the main vacuum chamber 403, whereby said fragment and remaining precursor ions are mass analyzed and detected by detector 20 whereby the generated signal is processed and stored or displayed by computer.

Cell 40 may further accumulate the incoming beam of ions (precursor ions) before undergoing fragmentation into the collision cell thereby further increasing the sensitivity of the mass spectrometer. Furthermore, outer housing 42 may be configured with a second gas inlet (not shown) such that the pressure may be established in outer housing 42 and inner housing 36 of cell 40 to provide CID in both sections. Ions may be accelerated into outer housing 42 by appropriate applications of voltages, and fragments may further be accelerated in inner housing 36 for additional fragmentations. Mass selection may be applied in either housing, if desired.

For example, outer housing 42 maintained at a lower pressure may be configured to fragment ions requiring lower fragmentation voltages, while inner housing 36 maintained at a higher pressure may be configured to fragment ions that require higher fragmentation voltages. Voltages may be accordingly synchronized to mass-to-charge transmitted by mass filter 14 of FIG. 4.

Figure 5:
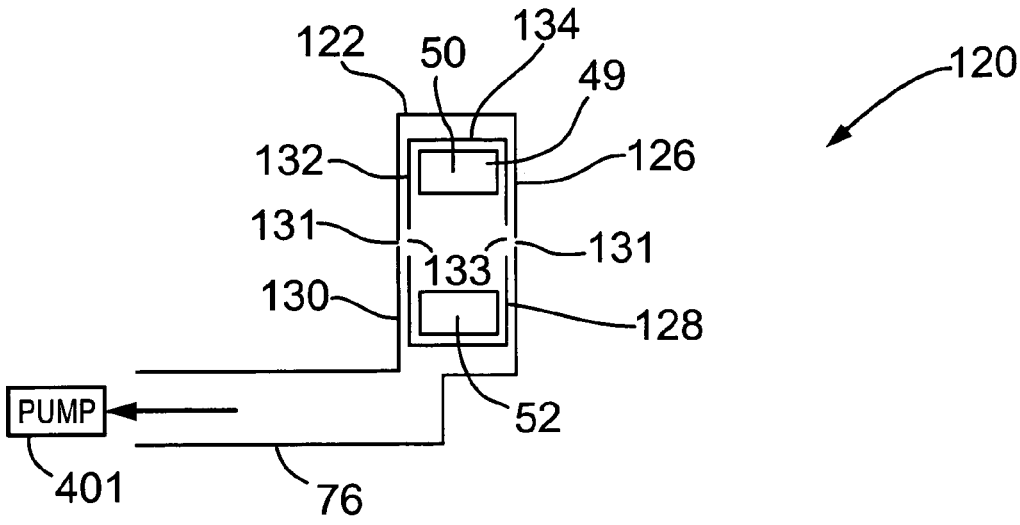
FIG. 5 shows an alternative embodiment of a high pressure collision cell in which the cell is differentially pumped.

FIG. 5 shows an alternative embodiment of a high pressure collision cell 120 constructed in accordance with the present invention which is evacuated by means of conduit 76 and pump 401, without ion guide optics before or after the cell 120. Cell 120 includes an outer housing 122 with one side of housing 122 being an electrode 126 and the other side being an electrode 130 with electrodes 126 and 130 having central apertures 131. On the inside of housing 122 is another housing 134 comprised of two electrodes 128 and 132 located on either side of the housing 134 with each electrode having a central aperture 133 which line up in a line with the apertures 131 in electrodes 126 and 130. In collision cell 120 the electrodes 126, 128, 130 and 132 are DC voltage driven electrostatic lenses.

Additionally DC voltage and RF voltage of opposite phase may be applied to electrodes 50 and 52 of ion guide 49 to improve transmission of ions into the high pressure region of the inner housing 134. RF voltage of opposite phase, and DC voltages, may be further applied to directly to electrodes 130, 132, 128 and 126 of collision cell 120 to induce a small trapping potential at the apertures 131 and 133.

Figure 6:
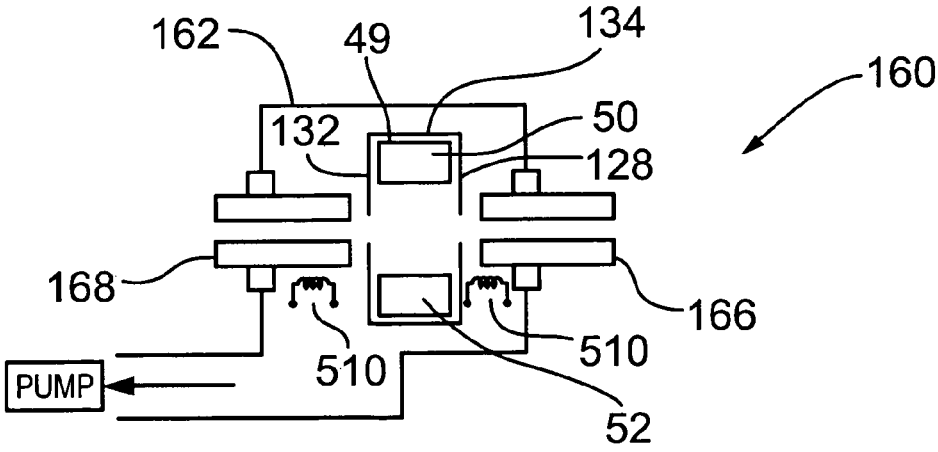
FIG. 6 shows another embodiment of a high pressure collision cell in which the cell is differentially pumped with the collision cell having low energy electron emitters for electron capture dissociation (ECD) permitting both ECD and collision induced dissociation (CID).

FIG. 6 shows a high pressure collision cell 160 which includes an outer housing 162 having two short ion guides 166 and 168 located in the entrance and exit of the walls of outer housing 162. Located in the interior chamber of outer housing 162 is an inner housing 134, the same as housing 134 shown in cell 120 of FIG. 5 containing ion guide 49. In collision cell 160, the two short ion guides 166 and 168 are used to replace electrodes 126 and 130 (FIG. 5) provided to interface between the high pressure region inside inner housing 134 and the low pressure region on the interior of outer housing 162 of collision cell 160. These ion guides 166 and 168 are configured such that they accommodate differential pumping, where one side is under high pressure and the other, under lower pressure. This configuration is also advantageous for transferring ions into and out of the collision cell 160.

Optionally, collision cell 160, (or any of the other collision cells disclosed herein) may be configured to include low energy electron emitter filaments 510 for ECD. Electron emitter filament 510 may be positioned in such a way as to emit low energy electrons on axis of ion guide 166 or 168, for example at a position in which the RF voltage is largely zero, or arranged such that electrons are emitted at a time when the RF is substantially zero. Ions may undergo ECD in ion guide 166 or 168 and conventional fragmentation in inner housing 134. Alternatively electrons may be injected into inner housing 134 directly, by means of an electron emitter attached to the end electrodes 128 or 132 of inner housing 134, for example.

Thus, advantageously, CID in the high pressure collision cell disclosed herein may be used in conjunction with ECD for efficiently analyzing large protein molecules. Due to the high pressure, substantially higher acceleration voltages are possible than in conventional cells, making it possible to deposit large amounts of energy and thereby to fragment very large molecules such as proteins. Since ECD and CID yield different fragmentation patterns, simultaneous implementation of ECD and high pressure CID may substantially increase the information content of the measurement. Other complementary techniques such as photodissociation may be used.

Figure 7:
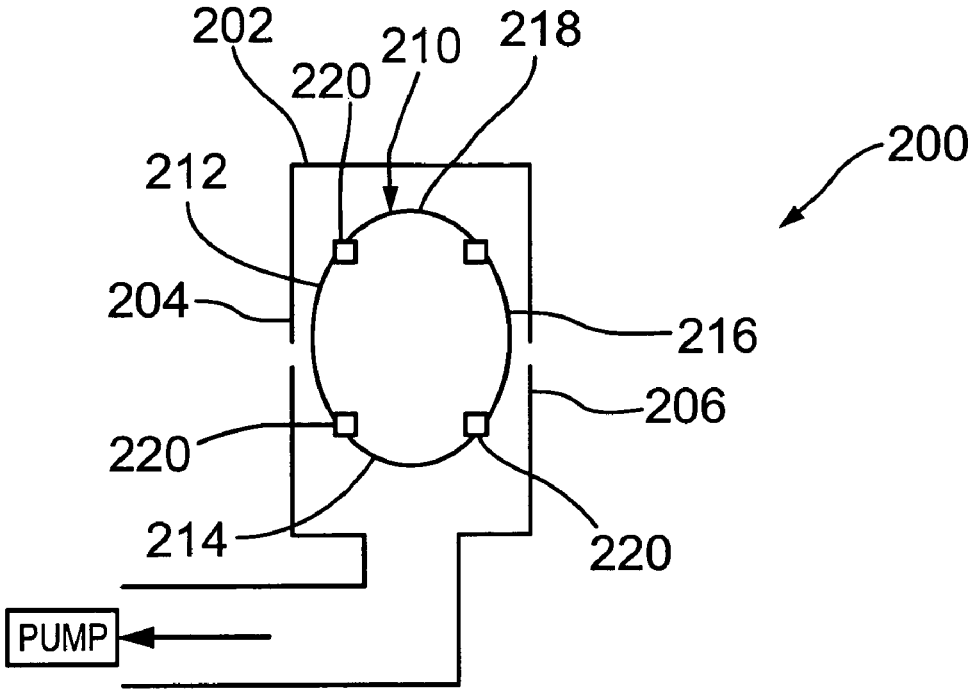
FIG. 7 shows another embodiment of a high pressure collision cell.

FIG. 7 shows another embodiment of a high pressure collision cell 200. Collision cell 200 includes a housing 202 with electrodes 204 and 206 forming opposing walls with aligned apertures. Collision cell 200 uses an RF confinement similar to that of a 3-D trap. The shape of the electrodes may be elliptical or circular and includes three basic components. The segmented center ring 210 includes four arch-shaped segments 212, 214, 216, 218 which are separated from each other by insulated junctions 220. These segments function in a similar way to the electrodes 50, 52 of ion guide 40, for example, and other ion guides cited herein. Application of an RF voltage will result in the formation of a pseudo-potential well in three dimensions. Electrode segments 212 and 216 are DC voltage driven electrostatic lenses and electrode segments 210 and 214 have only RF voltages applied to them.

Figure 8:
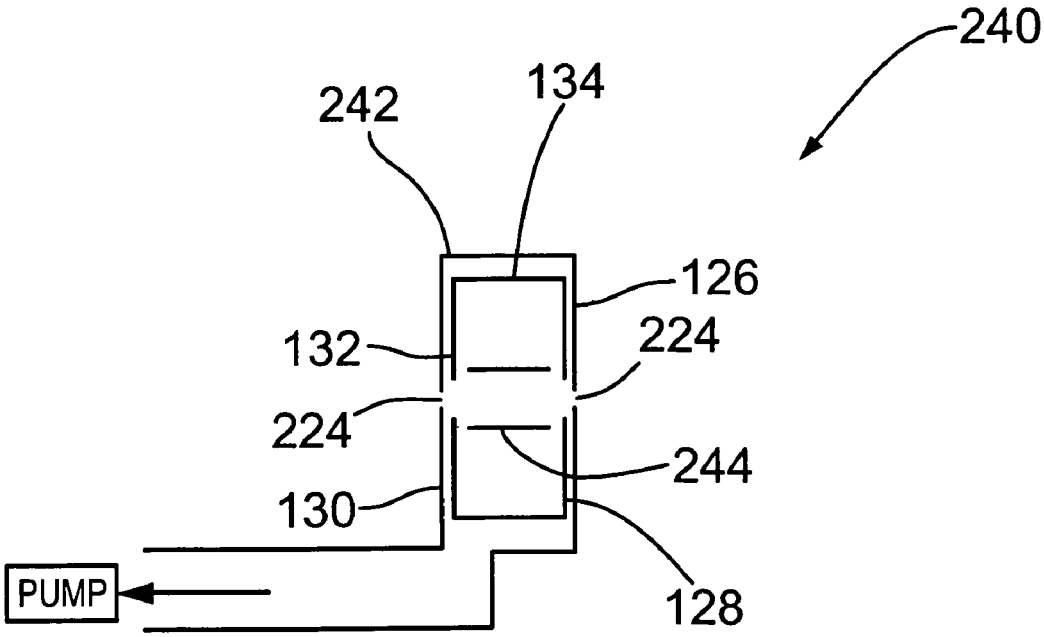
FIG. 8 shows another embodiment of a high pressure collision cell.

FIG. 8 shows another embodiment of a high pressure collision cell 240. Collision cell 240 includes a housing 242 with apertures 224 and two electrostatic lenses/electrodes 126, 130, and 128, 132 similar to cell 120 in FIG. 5. Collision cell 240 differs from cell 120 in that the inner electrodes 50 and 52 of ion guide 49 of cell 120 (FIG. 5) are replaced with a cylindrical ring or tube electrode 244. In one embodiment the inner ring electrode 244 is connected to an RF voltage source, and in another embodiment the inner ring 244 is connected to a DC power supply only.

With reference to FIG. 4, it will be understood that the outer housing 42 shown in FIG. 3 is optional and not necessarily required, as long as a suitable pumping configuration and gas throughput is used so that main vacuum chamber 403 sustains a pressure less than about $4\times10^{-5}$T. Furthermore, any of the high pressures cells described herein, may be retrofitted into inner housing 36.

Although the high pressure collision cells described herein are constructed with a linear configuration with entrance and exit apertures along a fixed axis perpendicular to entrance and exit electrodes, curved or angled collision cells may also be constructed, for example a 90 degree collision cell construction with entrance and exit apertures at 90 degrees with respect to incoming ion beam aligned along transverse flow axis 183. Additionally exit of outer housing 42 may comprise a curved ion guide to turn ions 90 degrees into entrance of inner housing 36. Preferable angles may be in the range from about 60 to about 120 degrees.

Overall, cell 40 exhibits several important advantages. First, cell 40 may be anywhere from about 10 to about 100 times shorter than the traditional collision cell, allowing a significant reduction in the size of the mass spectrometer in which it is located. Cell 40 shown in FIGS. 3 and 4 as well uses the voltage drop between the end electrostatic lens electrodes 60 and 62 in combination with DC offset of ion guide 49 to provide the necessary axial field as a mean of accelerating ions through the collision cell 40. Therefore there is no need for an additional axial field source. This reduces the complexity in construction and performance significantly. Finally, higher collision energies and shorter times between collisions may yield significant improvements in fragmentation information, especially for large molecules such as proteins.

Also, it will be appreciated that collision cell 40 of FIG. 4 may be also useful for mass spectrometer systems that requires very high vacuum, including tandem time of flight (TOF) and Fourier transfer mass spectrometry (FTMS), even with moderate or low pressures in inner housing 36. Cell 40 as disclosed in FIG. 4 for example may in fact contain inner housing 36 operating at conventional length and conventional pressure, for example 1 mTorr to 10 mTorr, while providing an overall improvement for systems requiring a high vacuum, due to differential pumping of conduit 76 and pump 401 of outer housing 42.

Additionally it will be appreciated that cell 40 of FIG. 4 may be operated with a conventional collision cell length as in conventional collision cells but higher pressure (about 50-1000 mTorr), therefore providing substantially larger target thickness, a range particularly useful for CID of large molecular ions such as proteins and other macromolecular ions. Although the axial field requirement may not be met, such a system provides qualitative analysis not possible with conventional collision cells. Electron capture dissociation (ECD) may be usefully implemented in this arrangement as well using cell 160 in FIG. 6.

Thus, the present invention provides apparatus and method for collision-induced dissociation of large molecules, such as, but not limited to proteins. The method includes directing an ion beam containing molecules being analyzed into a collision cell and having a pressure maintained in a range from about 50 mTorr to about 1000 mTorr applying voltages to electrodes located in the collision cell suitable to provide lab frame collision energies in a range of from about 10 to about 500V for collision-induced dissociation (CID) of large molecules.

Electron capture dissociation (ECD) may be usefully implemented by including emitting low energy electrons in the collision cell, and applying voltages to the electrodes suitable to induce electron capture dissociation and to provide collision-induced dissociation (CID) and electron capture of large molecules.

As used herein, the terms, "comprises" and "comprising" are to be construed as being inclusive and open ended, and not exclusive. Specifically, when used in this specification including claims, the terms, "comprises" and "comprising" and variations thereof mean the specified features, steps or components are included. These terms are not to be interpreted to exclude the presence of other features, steps or components.

The foregoing description of the preferred embodiments of the invention has been presented to illustrate the principles of the invention and not to limit the invention to the particular embodiment illustrated. It is intended that the scope of the invention be defined by all of the embodiments encompassed within the following claims and their equivalents.

Therefore what is claimed is:

1. A high pressure collision cell for use in a mass spectrometer, comprising:

a) a first housing enclosing a first chamber including first and second opposed elongate electrically conducting electrodes each having an aperture and spaced apart a length L thereby defining a collision cell length, each of said first and second opposed elongate electrically conducting electrodes forming an electrostatic lens, said first and second opposed elongate electrically conducting electrodes being positioned with respect to each other so that said apertures in each are generally aligned along a transverse flow axis through said first chamber between said first and second opposed elongate electrically conducting electrodes;

b) chamber walls between said first and second opposed elongate electrically conducting electrodes to enclose said first chamber, said chamber walls being electrically isolated from said first and second opposed elongate electrically conducting electrodes and being sealed to said first and second opposed elongate electrically conducting electrodes in such a way as to provide a pressure seal;

c) a gas injection port on said housing for injecting an inert gas into said first chamber, a pumping port on said first housing and a pump for pumping said inert gas out of said first chamber;

d) a power supply for applying a selected voltage to said first and second opposed elongate electrically conducting electrodes; and e) said collision cell length L selected to be in a range such that upon application of said selected voltage to said first and second opposed elongate electrically conducting electrodes there is produced an electric field of sufficient strength across said collision cell length L in said first chamber to aid in directing ions across said collision cell length L along said transverse flow axis; and f) pressure controller for maintaining a pressure in said collision cell in a range from about 50 mTorr to 1000 mTorr and wherein said collision cell length L and said pressure are selected such that a target thickness, defined as a product of the collision cell length and the pressure, is maintained in a range from about 0.2 to about 2 mmTorr.

2. The high pressure collision cell according to claim 1 wherein said pressure controller is configured to maintain a pressure of said inert gas in said first chamber sufficiently high enough such that a ratio of E/P, where E is an electric field strength across said collision cell length L, and P is a pressure atoms/molecules of said inert gas in said first chamber, is maintained in a range from about 1 to about 5 V per mm per Torr.

3. The high pressure collision cell according to claim 1 wherein said chamber walls continuously extend between first ends of said first and second opposed elongate electrically conducting electrodes, said chamber walls being sealed to respective ends of said first and second opposed elongate electrically conducting electrodes by an electrically insulating seal, and said chamber walls being electrically conducting, and wherein said power supply is configured to apply selected voltages to said chamber walls.

4. The high pressure collision cell according to claim 1 including an additional pumping port for pumping said inert gas out of said first chamber to aid in guiding ions out of said collision cell.

5. The high pressure collision cell according to claim 1 wherein said gas injection port is a gas injection nozzle positioned parallel to said transverse flow axis.

6. The high pressure collision cell according to claim 1 wherein said gas injection port is a gas injection aperture positioned parallel to said transverse flow axis.

7. The high pressure collision cell according to claim 1 including electrode means located between said first and second opposed elongate electrically conducting electrodes and symmetrically disposed on either side of said transverse flow axis through said first chamber between said first and second opposed elongate electrically conducting electrodes, and wherein upon application of a suitable voltage to said electrode means an additional axial electric field is formed in said first chamber configured to further aid in directing ions entering said collision cell through one of said apertures along said transverse flow axis.

8. The high pressure collision cell according to claim 1 including a first ion guide located outside said first chamber spaced from said first opposed elongate electrically conducting electrode, including a second ion guide located outside said first chamber and spaced from said second opposed elongate electrically conducting electrode, said first and second ion guides being symmetrically disposed on either side of said transverse flow axis through said first chamber on either side outside said first and second opposed elongate electrically conducting electrodes, and wherein upon application of a suitable voltage to said first and second ion guides an additional axial electric field is formed in said first chamber configured to aid in directing ions entering said collision cell through one of said apertures along said transverse flow axis.

9. The high pressure collision cell according to claim 1 including multiple electrostatic lenses located outside said first chamber and symmetrically disposed on either side of said transverse flow axis through said first chamber on either side of said housing, and wherein upon application of a suitable voltage to said multiple electrostatic lenses an additional axial electric field is formed in said first chamber configured to aid in directing ions entering said collision cell through one of said apertures along said transverse flow axis.

10. The high pressure collision cell according to claim 1 including a second housing enclosing a second chamber, said first housing being located inside said second housing, said second housing having first and second opposed side walls each forming an electrostatic lens, each of said first and second opposed sidewalls having an associated aperture, including an additional pumping port connected to said second housing in flow communication with a pump for pumping said first and second chambers for differentially pumping said first and second collision cell housings compared to an interior of a spectrometer housing in which said collision cell is retrofitted, and wherein said pressure controller is configured to maintain a pre-selected pressure in said first and second chambers.

11. The collision cell according to claim 10 including an ion guide located in said second chamber and aligned adjacent to said aperture in one of said first and second opposed elongate electrically conducting electrodes, said ion guide being configured to focus and direct an ion beam entering said second housing through the aperture in one of said first and second opposed sidewalls into said first housing through on of the apertures in one of said first and second opposed elongate electrically conducting electrodes.

12. The collision cell according to claim 10 including multiple electrostatic lenses located in said second chamber and aligned adjacent to said aperture in one of said first and second opposed elongate electrically conducting electrodes, said multiple lenses being configured to focus and direct an ion beam entering said second housing into said first housing through one of the apertures in one of said first and second opposed elongate electrically conducting electrodes, and wherein said power supply is configured to apply RF and DC voltages to said multiple electrostatic lenses.

13. The collision cell according to claim 10 including multiple electrostatic lenses located in said second chamber and aligned adjacent to said aperture in one of said first and second opposed elongate electrically conducting electrodes, said multiple lenses being configured to focus and direct an ion beam entering said second housing into said first housing through one of the apertures in one of said first and second opposed elongate electrically conducting electrodes, and wherein said power supply is configured to apply DC voltages to said multiple electrostatic lenses.

14. The collision cell according to claim 10 wherein said first housing is oriented with respect to said second housing such that said apertures in said first and second opposed side walls of said second housing are aligned with said apertures in said first and second opposed elongate electrically conducting electrodes of said first housing along said transverse flow axis.

15. The collision cell according to claim 10 wherein said first housing is oriented with respect to said second housing such that said apertures in said first and second opposed side walls of said second housing are disposed at an angle of between about 60 to about 120 degrees with respect to said apertures in said first and second opposed elongate electrically conducting electrodes of said first housing.

16. The collision cell according to claim 10 including a first ion guide located in the aperture in said first opposed side wall of said second housing and a second ion guide located in the aperture in said second opposed side wall of said second housing, said first and second ion guides being electrically isolated from said first and second opposed side walls of said second housing.

17. The collision cell according to claim 7 wherein said electrode means includes a cylindrical tube electrode having a cylindrical axis aligned along said transverse flow axis, and wherein said power supply is configured to apply any one of radio frequency (RF) voltages, DC voltages and combinations thereof to said cylindrical tube electrode.

18. The collision cell according to claim 10 wherein including electrode means comprising first and second pole electrodes aligned symmetrically aligned along either side of the transverse flow axis.

19. The collision cell according to claim 7 wherein said electrode means includes four arch-shaped electrode segments in the shape of a ring with each segment being separated from its neighbor by insulators, and wherein said power supply is configured to apply an RF voltage to a first group of two opposed arch-shaped electrode segments and to apply DC voltages to a second group of two opposed arch-shaped electrode segments.

20. The collision cell according to claim 10 including low energy electron emitter filaments positioned in said first and second housing configured such that ions undergo electron capture dissociation (ECD) in said first and/or second housings.

21. The collision cell according to claim 10 including low energy electron emitter filaments positioned in said first and second housing configured such that ions undergo electron capture dissociation (ECD) in said first and/or second housings, and nearly simultaneous collision induced dissociation (CID) in first or second housings.

22. The collision cell according to claim 10, wherein said pressure controller is configured to maintain said second chamber at a lower pressure and said first chamber at a higher pressure, said power supply being configured to apply voltages to all electrostatic lenses such that, in conjunction with different pressures in said first and second chambers, gives fragmentation of ions at different voltages in said first and second chambers, and wherein said voltages are accordingly synchronized to mass-to-charge.

23. A method for producing collisions to dissociate molecules during mass spectrometry, comprising:

directing an ion beam containing molecules being analyzed into a collision cell having a collision cell length L, and having a pressure maintained in a range from about 50 mTorr to 1000 mTorr and wherein said collision cell length L and said pressure are selected such that a target thickness, defined as a product of the collision cell length and the pressure, is maintained in a range from about 0.2 to about 2 mm-Torr, and said collision cell length L being selected to be in a range such that upon application of voltages to electrodes forming part of the collision cell, there is produced an electric field of sufficient strength across said collision cell length L to aid in directing ions across said collision cell length L along a transverse flow axis through said collision cell.

24. The method according to claim 23 including applying voltages to said electrodes suitable to provide lab frame collision energies in a range of from about 10 to about 500V for CID of large molecules.

25. The method according to claim 23 including emitting low energy electrons in said collision cell, and applying voltages to said electrodes suitable to induce electron capture dissociation and to provide CID and electron capture of large molecules.

26. The method according to claim 23 including maintaining a pressure in said collision cell, and applying voltages to said electrodes suitable to fragment low m/z and large m/z simultaneously by varying pressure and voltage.

27. The method according to claim 23 wherein said collision cell includes an inner housing and an outer housing, including maintaining a pressure in said inner and outer housings suitable to fragment low energy low mass ions in said outer housing and high mass ions in said inner housing.

28. A high pressure collision cell for use in a mass spectrometer, comprising:

a) a first housing including first and second opposed elongate electrically conducting electrodes each having an aperture and spaced apart a length L thereby defining a collision cell length, each of said first and second opposed elongate electrically conducting electrodes forming an electrostatic lens, said first and second opposed elongate electrically conducting electrodes being positioned with respect to each other so that said apertures in each are aligned along a transverse flow axis through said first housing between said first and second opposed elongate electrically conducting electrodes;

b) chamber walls enclosing a first chamber between said first and second opposed elongate electrically conducting electrodes, said chamber walls being electrically isolated from said first and second opposed elongate electrically conducting electrodes and being sealed to said first and second opposed elongate electrically conducting electrodes in such a way as to provide a pressure seal;

c) gas injection port for injecting an inert gas into said first chamber, and an external pumping volume for pumping said inert gas out of said first chamber through a pumping port;

d) a power supply for applying a selected voltage to said first and second opposed elongate electrically conducting electrodes; and e) a second housing enclosing a second chamber, said first housing being located inside said second housing, said second housing having first and second opposed side walls each forming an electrostatic lens, each of said first and second opposed sidewalls having an associated aperture, said wherein said pumping port is connected to said second housing in flow communication with a pump for pumping said first and second chambers for differentially pumping said first and second collision cell housings compared to an interior of a spectrometer housing in which said collision cell is retrofitted, and wherein said pump is an inter-stage pump in common with the interior of the the spectrometer housing and wherein said collision cell length L and a pressure in the collision cell are selected such that a target thickness, defined as a product of the collision cell length and the pressure, is maintained in a range from about 0.2 to about 2 mm-Torr.

29. The high pressure collision cell according to claim 28 wherein including a pressure controller for maintaining the pressure in said collision cell in a range from about 50 mTorr to about 1000 mTorr.

30. The high pressure collision cell according to claim 28 wherein including a pressure controller for maintaining the pressure in said collision cell in a range from about 1 mTorr to 10 mTorr.

31. A method for producing high energy collisions to dissociate molecules during mass spectrometry, comprising directing an ion beam containing molecules being analyzed into a collision cell having a collision cell length L and a pressure maintained in a range from about 50 mTorr to about 1000 mTorr, applying voltages to electrodes located in said collision cell suitable to fragment low m/z and large m/z simultaneously by varying pressure and voltage and wherein said collision cell length L and a pressure in the collision cell are selected such that a target thickness, defined as a product of the collision cell length and the pressure, is maintained in a range from about 0.2 to about 2 mm-Torr.

32. The method according to claim 31 including emitting low energy electrons in said collision cell, and applying voltages to said electrodes suitable to induce electron capture dissociation and to provide collision-induced dissociation (CID) and electron capture of large molecules.

33. The method according to claim 32 where said large molecules are proteins.

* * * * *